US006987373B2

(12) United States Patent
Kagami et al.

(10) Patent No.: US 6,987,373 B2
(45) Date of Patent: Jan. 17, 2006

(54) SYSTEM AND METHOD FOR STARTING PUMP

(75) Inventors: Masanao Kagami, Kariya (JP); Toshiro Fujii, Kariya (JP); Kazuho Yamada, Kariya (JP); Tatsuyuki Hoshino, Kariya (JP); Takayuki Hirano, Kariya (JP)

(73) Assignee: Kabushiki Kaisha Toyota Jidishokki, Aichi-ken (JP)

( * ) Notice: Subject to any disclaimer, the term of this patent is extended or adjusted under 35 U.S.C. 154(b) by 0 days.

(21) Appl. No.: 10/994,890

(22) Filed: Nov. 22, 2004

(65) Prior Publication Data

US 2005/0110446 A1 May 26, 2005

(30) Foreign Application Priority Data

Nov. 25, 2003 (JP) ..... P2003-394111

(51) Int. Cl.
*H02P 1/04* (2006.01)

(52) U.S. Cl. ..... 318/471; 318/430; 318/431; 123/179.3; 417/44.11

(58) Field of Classification Search ..... 318/430–434; 290/36 R, 38 R; 417/44.11, 44.22; 123/179.3
See application file for complete search history.

(56) References Cited

U.S. PATENT DOCUMENTS 4,487,173 A * 12/1984 Maucher et al. ..... 123/179.22
4,706,005 A * 11/1987 Iwako ..... 318/603
5,396,159 A * 3/1995 Kaneda ..... 318/431
6,054,826 A * 4/2000 Murakami et al. ..... 318/471
6,148,781 A * 11/2000 Boegner et al. ..... 123/179.3
6,345,216 B1 * 2/2002 Morimoto et al. ..... 701/22
6,593,713 B2 * 7/2003 Morimoto et al. ..... 318/139
2002/0185098 A1 * 12/2002 Perry et al. ..... 123/179.3
2003/0140881 A1 * 7/2003 Makajima et al. ..... 123/179.3
2004/0213676 A1 * 10/2004 Phillips ..... 417/44.11

FOREIGN PATENT DOCUMENTS

JP 2003-178782 6/2003

* cited by examiner

*Primary Examiner*—Paul Ip
(74) *Attorney, Agent, or Firm*—Knoble Yoshida & Dunleavy LLC

(57) ABSTRACT

A starting system for a pump includes a driving motor, an electric source, a selector switch, a starter sensor, a temperature sensor and a control unit. The selector switch is located between the driving motor and the electric source for reversing polarity of the electric power supplied from the electric source to the driving motor. The starter sensor senses whether or not the driving motor has been started. The temperature sensor senses a temperature. The control unit operates the selector switch so as to repeatedly give the driving motor indications of reverse rotation and normal rotation in a case where the starter sensor does not sense that the driving motor has been started even if the control unit operates the selector switch so as to give the driving motor the indication of normal rotation in a state where the temperature sensed by the temperature sensor is below a preset temperature.

34 Claims, 5 Drawing Sheets

SYSTEM AND METHOD FOR STARTING PUMP

BACKGROUND OF THE INVENTION

The present invention relates to a system and a method for starting a pump, and in particular to a starting in an environment of a low temperature.

Japanese Unexamined Patent Publication No. 2003-178782 discloses a fuel cell system which generates electricity through reaction of hydrogen gas and air. A part of the hydrogen gas which is supplied to a hydrogen electrode of a fuel cell stack is often contained in hydrogen off-gas without being reacted and is exhausted from the fuel cell stack. To effectively utilize the unreacted hydrogen gas, such a system is proposed that a hydrogen pump circulates the hydrogen off-gas to the hydrogen electrode of the fuel cell stack.

However, since water is produced with generation of electricity in the fuel cell system and this water is exhausted from the fuel cell stack with the hydrogen off-gas, moisture is introduced into the hydrogen pump with the hydrogen off-gas. Therefore, if the operation of the fuel cell system is stopped in an environment of a low temperature, there is fear that the moisture in the hydrogen pump condenses and freezes therein. Even in an air pump for supplying air to an oxygen electrode of the fuel cell stack, there is also fear that moisture in introduced air or a backflow of humidification air from an exhaust-side causes freeze inside the air pump.

If a roots pump shown in FIG. 4 is adapted for the hydrogen pump or the air pump, the moisture remains in a space between a pair of rotors 21, or in a space between each rotor 21 and a casing 22, and freezes therein due to surface tension of water. If the moisture freezes in the surface of each rotor 21, there is fear that the roots pump is not capable of being started upon restarted.

SUMMARY OF THE INVENTION

In order to solve the above and other problems, according to a first aspect of the current invention, a starting system for a pump including a motor for driving the pump, an electric source connected to the driving motor for supplying the driving motor with electric power, a selector switch located between the driving motor and the electric source for reversing polarity of the electric power supplied from the electric source to the driving motor while selectively connecting the driving motor to the electric source and disconnecting the driving motor from the electric source, a starter sensor provided with the driving motor for sensing whether or not the driving motor has been started, a temperature sensor provided for sensing a temperature, and a control unit connected to the electric source, the selector switch, the starter sensor and the temperature sensor, wherein the control unit operates the selector switch so as to repeatedly give the driving motor indications of reverse rotation and normal rotation in a case where the starter sensor does not sense that the driving motor has been started even if the control unit operates the selector switch so as to give the driving motor the indication of normal rotation in a state where the temperature sensed by the temperature sensor is a preset temperature or below.

According to the second aspect of the current invention, a method of starting a pump including a motor for driving the pump, including the steps of sensing a temperature, giving the driving motor an indication of normal rotation, and starting the driving motor by giving the driving motor indications of reverse rotation and normal rotation repeatedly in a case where the driving motor is not started even if the indication of normal rotation is given to the driving motor in a state where the sensed temperature is a preset temperature or below.

According to the third aspect of the current invention, a starting system for a pump motor, including a starter sensor located near the pump motor for ultimately determining an operational status of the pump motor, the operational status being active and inactive, a temperature sensor for detecting a temperature, and a control unit connected to the starter sensor and the temperature sensor for generating a signal to the pump motor, in response to the inactive operational status from the starter sensor after a predetermined normal activation attempt of starting the pump motor, the control unit generating a reverse/forward rotation signal sequence indicative of alternately rotating the pump motor in a predetermined reverse direction and a predetermined forward direction if the detected temperature is equal to or below a predetermined temperature.

According to the fourth aspect of the current invention, a method of starting a pump motor, including the steps of rotating the pump motor in a predetermined forward direction, determining an operational status of the pump motor, the operational status being active and inactive, in response to the inactive operational status, detecting a temperature, and generating a reverse/forward rotation signal sequence indicative of alternately rotating the pump motor in a predetermined reverse direction and the predetermined forward direction if the detected temperature is equal to or below a predetermined temperature.

BRIEF DESCRIPTION OF THE DRAWINGS

The features of the present invention that are believed to be novel are set forth with particularity in the appended claims. The invention, together with objects and advantages thereof, may best be understood by reference to the following description of the presently preferred embodiments, together with the accompanying drawings, in which:

DETAILED DESCRIPTION OF THE PREFERRED EMBODIMENTS

Figure 1:
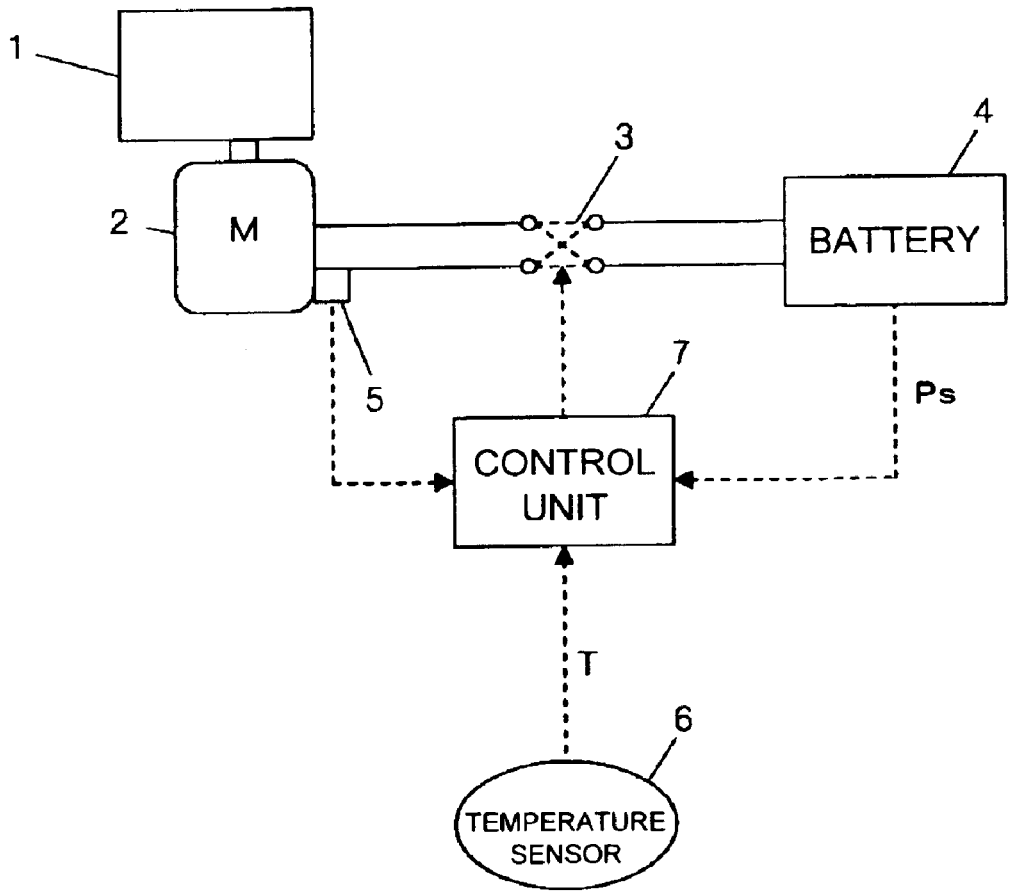
FIG. 1 is a block diagram showing a structure of a starting system for a roots pump according to a first preferred embodiment of the present invention.

A first preferred embodiment of the present invention will now be described with reference to FIGS. 1 through 4. A structure of a system for starting a roots pump 1 which is adapted for a hydrogen pump or an air pump in a fuel cell system is shown in FIG. 1. The roots pump 1 is provided with a motor 2 for driving the roots pump 1. The driving motor 2 is connected to a battery 4 that serves as an electric source through a selector switch 3. The driving motor 2 is also provided with a starter sensor 5 for sensing whether or not the driving motor 2 has been started. In addition, a temperature sensor 6 is provided for measuring an outdoor air temperature T. The selector switch 3, the battery 4, the starter sensor 5 and the temperature sensor 6 are connected to a control unit 7.

When the selector switch 3 is switched, the polarity of electric power supplied from the battery 4 to the driving motor 2 is reversed while the battery 4 is selectively connected to the driving motor 2 and disconnected from the driving motor 2, thereby giving the driving motor 2 indications of normal rotation and reverse rotation selectively.

Figure 2:
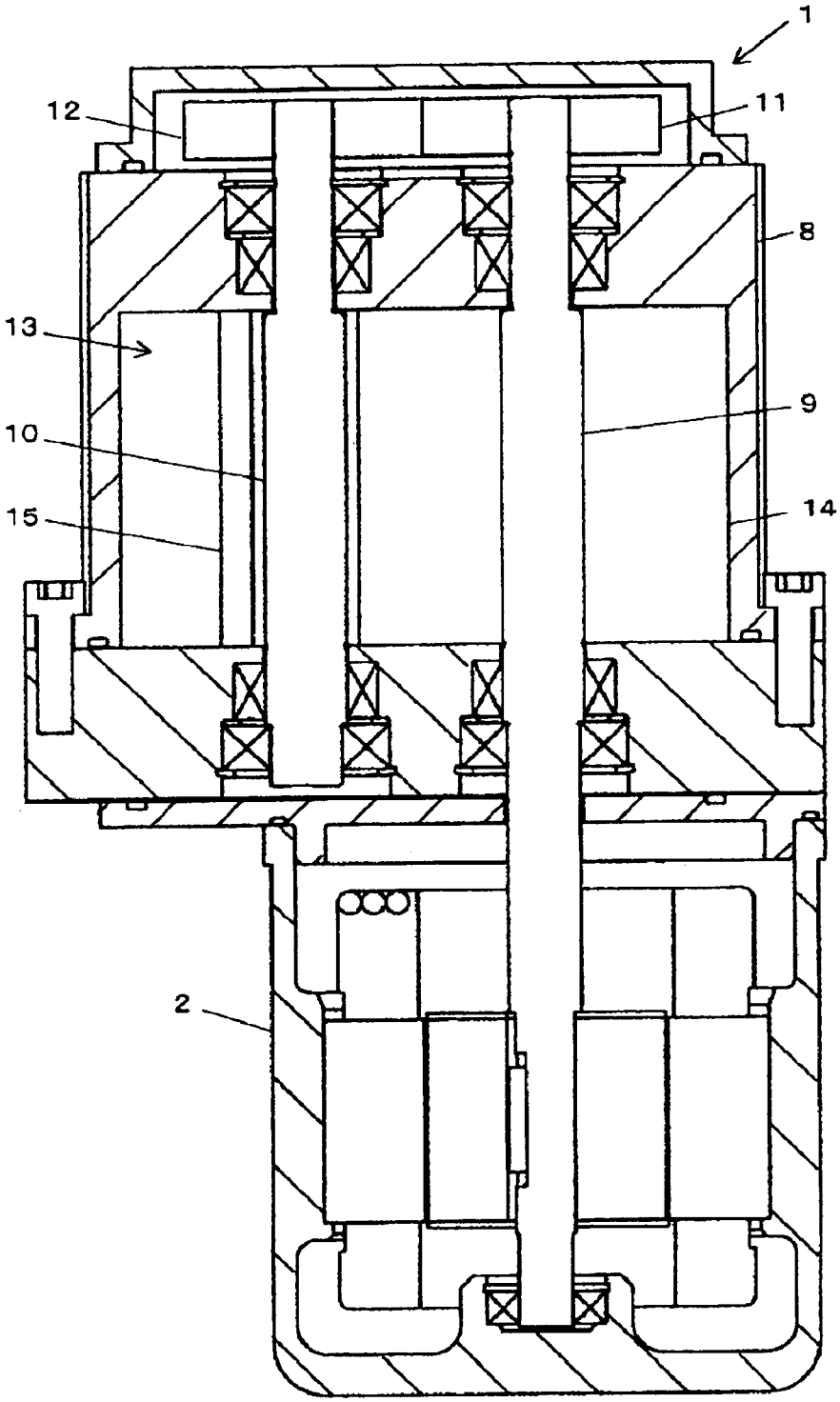
FIG. 2 is a sectional view showing an inside of the roots pump.

FIG. 2 shows an internal structure of the roots pump 1. The roots pump 1 has a casing 8 in which a drive shaft 9 and a driven shaft 10 are rotatably arranged so as to be parallel with each other. One end of the drive shaft 9 is provided with a drive gear 11, and one end of the driven shaft 10 is provided with a driven gear 12. The drive gear 11 engages with the driven gear 12. The drive shaft 9 and the driven shaft 10 have passed through a rotor chamber 13 defined in the casing 8. The drive shaft 9 and the driven shaft 10 have fixed respectively a first rotor 14 and a second rotor 15 in the rotor chamber 13. The other end of the drive shaft 9 protrudes from the casing 8, and forms a rotary shaft of the driving motor 2 fixed to the casing 8.

As the drive shaft 9 rotates by the driving motor 2, the driven shaft 10 is rotated in an opposite direction to the drive shaft 9 through the drive gear 11 and the driven gear 12. Thus, the first rotor 14 and the second rotor 15 are rotated in an opposite direction to each other (as shown by a pair of rotors 21 in FIG. 4), and intake and exhaust occur in the rotor chamber 13, accordingly.

Figure 3:
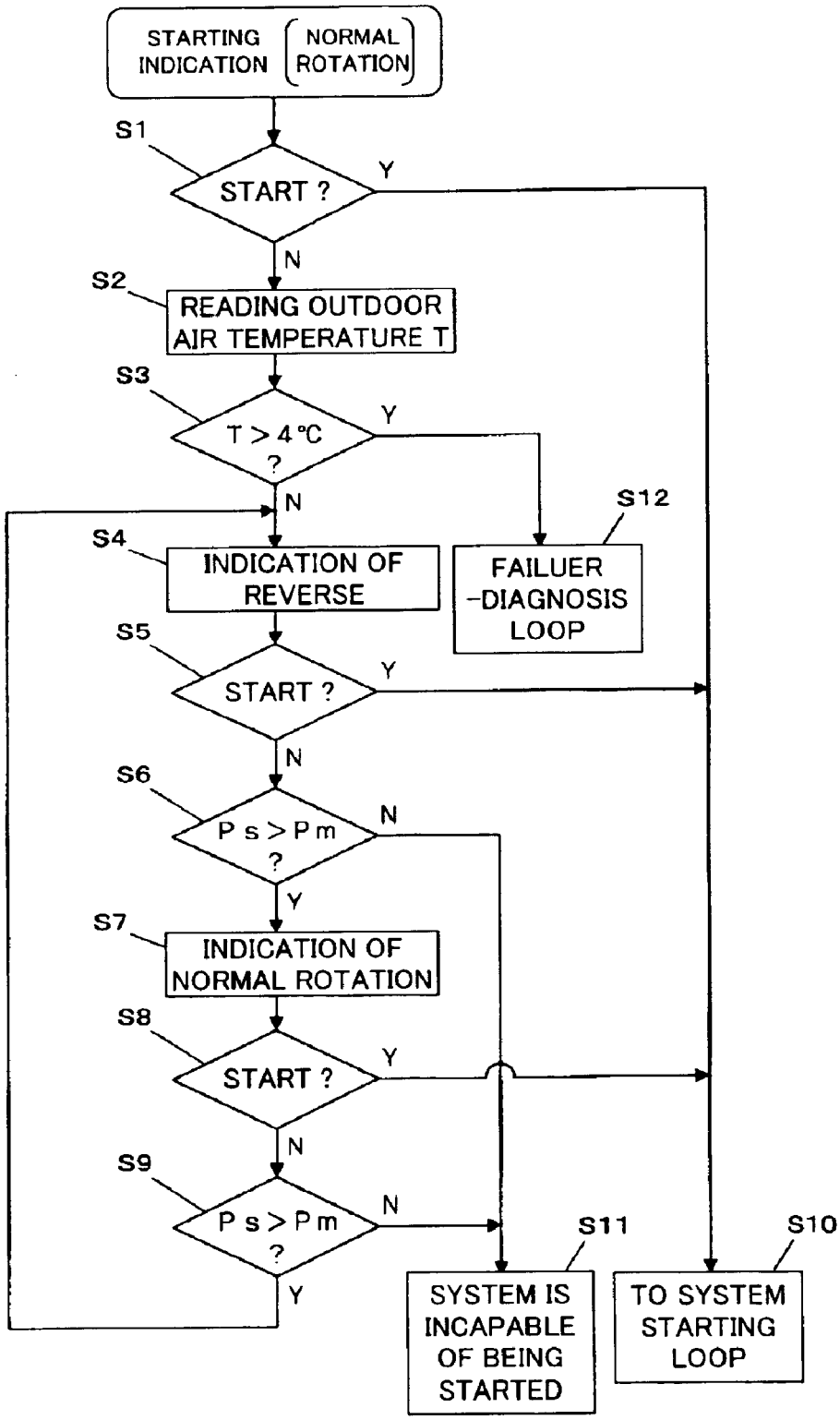
FIG. 3 is a flow chart showing an operation of the first preferred embodiment of the present invention.
Figure 4:
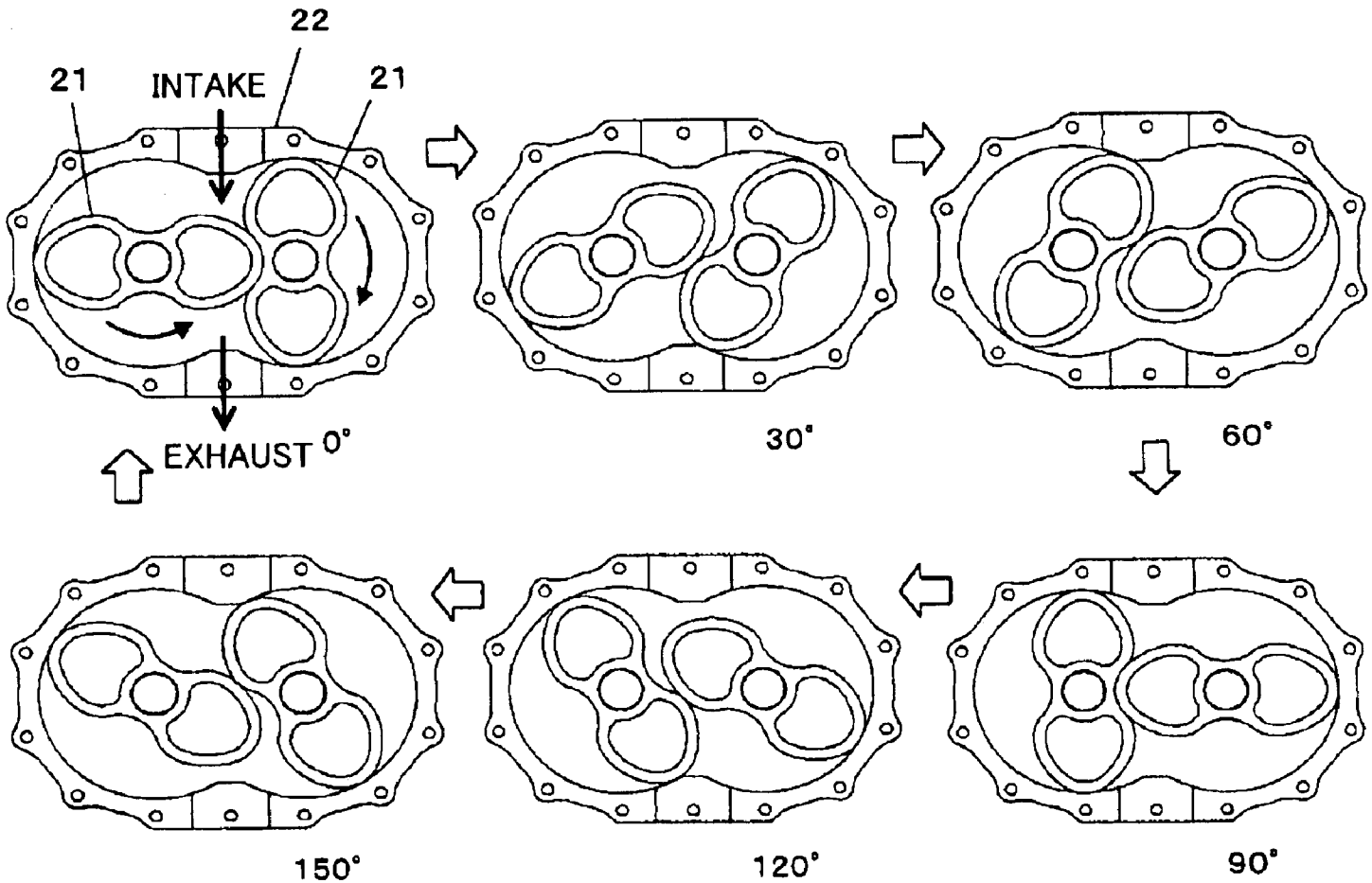
FIG. 4 is a sectional view showing an operation of a roots pump stepwise.

Operation of the present embodiment will now be explained with reference to a flow chart in FIG. 3. When the control unit 7 operates the selector switch 3 so as to supply electric power from the battery 4 to the driving motor 2 thereby giving the driving motor 2 a starting indication in a direction of normal rotation, the control unit 7 judges whether or not the driving motor 2 has been started by a signal from the starter sensor 5 in a step S1. In a case where the control unit 7 judges that the driving motor 2 has not been started, the control unit 7 reads an outdoor air temperature T sensed by the temperature sensor 6 in a step S2. Subsequently, the control unit 7 contrasts the value of the outdoor temperature T and a preset temperature such as 4 degrees C. in a step S3.

If the outdoor air temperature T is 4 degrees C. or below, it is estimated that the driving motor 2 is not started due to a freeze of moisture inside the roots pump 1, and the control unit 7 operates the selector switch 3 in a step S4 so as to reverse the polarity of the electric power supplied from the battery 4 to the driving motor 2, thereby giving the driving motor 2 a starting indication in a direction of reverse rotation. Subsequently, the control unit 7 judges whether or not the driving motor 2 has been started by the signature from the starter sensor 5 in a step S5. In a case where the control unit 7 judges that the driving motor 2 has not been started, the control unit 7 contrasts a charging capacity Ps of the battery 4 and a preset value Pm in a step S6.

If the charging capacity Ps exceeds in the preset value Pm, it is estimated that the control unit 7 is capable of proceeding with a starting process in this state, and the control unit 7 operates the selector switch 3 in a step S7 so as to reverse the polarity of the electric power supplied from the battery 4 to the driving motor 2 once again, thereby giving the driving motor 2 the starting indication in the direction of normal rotation this time. Subsequently, the control unit 7 judges whether or not the driving motor 2 has been started by the signature from the starter sensor 5 in a step S8. In a case where the control unit 7 judges that the driving motor 2 has not been started, the control unit 7 contrasts the charging capacity Ps of the battery 4 and the preset value Pm in a step S9. If the charging capacity Ps exceeds in the preset value Pm, the control unit 7 returns the process from the step S9 to the step S4, thereby giving the driving motor 2 the starting indication in the direction of reverse rotation.

Thus, the processes of the step S4 through the step S9 are repeated until the driving motor 2 is started, and the indications of the reverse rotation and the normal rotation are repeatedly given to the driving motor 2 by the control unit 7.

In a case where the control unit 7 judges that the driving motor 2 has been started by the signature from the starter sensor 5 in the step S1, S5 or S8, those steps proceed to a step S10. The control unit 7 gives the driving motor 2 the starting indication in the direction of normal rotation once more in a system starting loop, the fuel cell system as a whole is started while the operation of the roots pump 1 is started. It is noted that in a case where the driving motor 2 is started when the control unit 7 gives the driving motor 2 the instruction of starting in the direction of normal rotation, the driving motor 2 may continue the operation and be followed by the starting of the fuel cell system as a whole.

In a case where the control unit 7 judges that the charging capacity Ps of the battery 4 is the preset value Pm or below in the step S6 or S9, it is estimated that the charging capacity Ps is insufficient to start the operation of the fuel cell system as a whole after the operation of the pump is started even if the starting process proceeds in this state. In this case, those steps proceed to a step S11, in which the starting process is ended for the reason that the fuel cell system is incapable of being started.

Further, if the outdoor air temperature T is above 4 degrees C. in the step S3, it is estimated that the driving motor 2 is incapable of being started for the causes other than the freeze of the moisture. In this case, the step S3 proceeds to a step S12, in which the cause of impossibility of the starting is investigated in a failure-diagnosis loop.

In the first embodiment of the present invention, reverse rotation and normal rotation are repeated by the driving motor if the driving motor is not started after normal rotation is attempted by the driving motor of the roots pump in a low temperature environment. If the moisture freezes inside the roots pump, the frozen moisture is peeled off from the rotor or the casing of the roots pump by torque of reverse rotation and normal rotation. Thereby, the roots pump is enabled to start.

Figure 5:
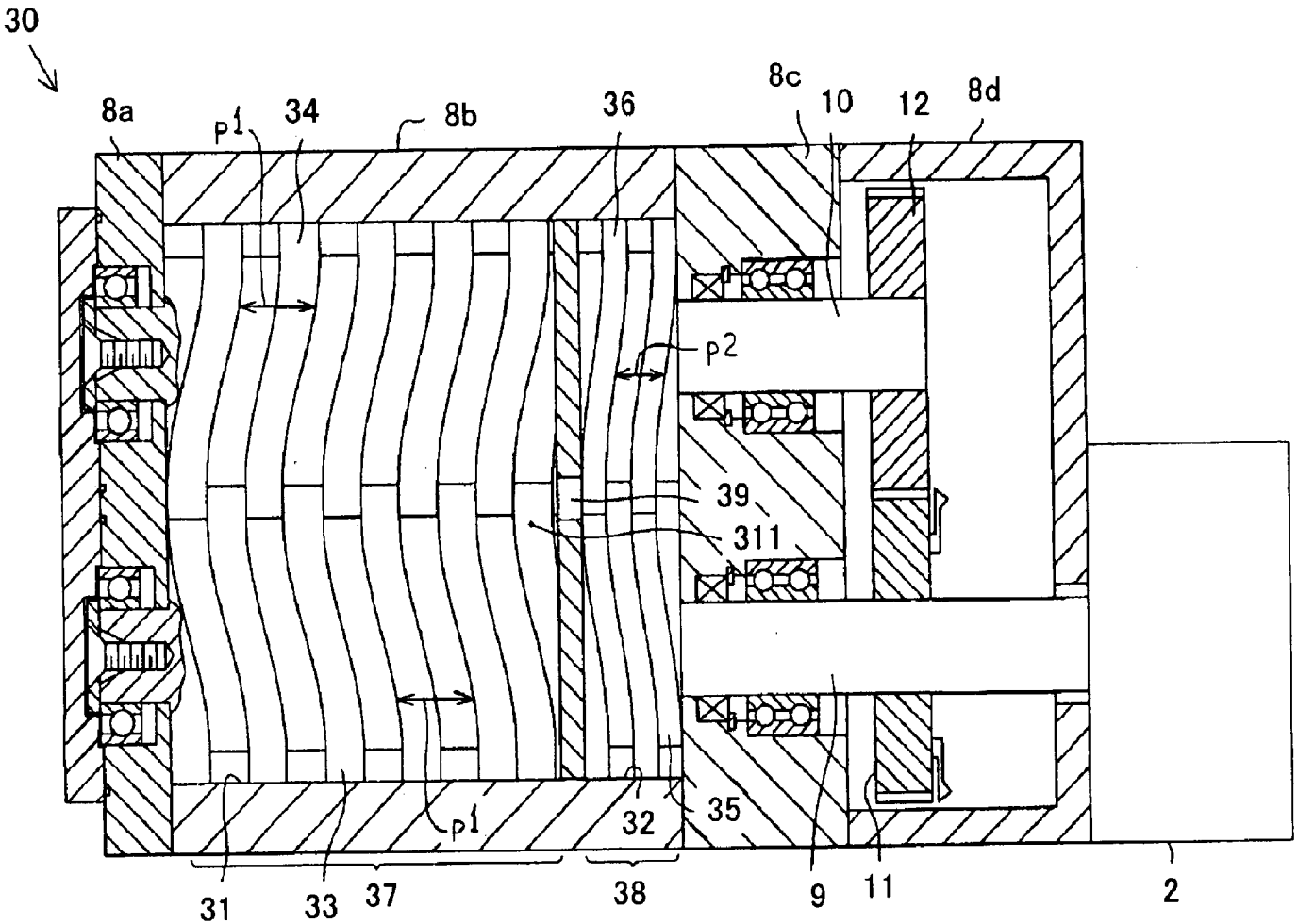
FIG. 5 is a sectional view showing an inside of a screw pump according to a second preferred embodiment of the present invention.

A second preferred embodiment will now be described with reference to FIG. 5. In the second preferred embodiment, a screw pump 30 is used in the fuel cell system instead of the roots pump 1. The same reference numerals of the first preferred embodiment are applied to substantially the same components in the second preferred embodiment. FIG. 5 shows an internal structure of the screw pump 30.

The screw pump 30 has a front housing 8*a*, a rotor housing 8*b*, a rear housing 8*c* and a gear housing 8*d*. The front housing 8*a* is joined to the rotor housing 8*b*. The rotor housing 8*b* is joined to the rear housing 8*c*. The rear housing 8*c* is joined to the gear housing 8*d*. These housings 8*a*, 8*b*, 8*c*, 8*d* form a screw pump housing in which the drive shaft 9 and the driven shaft 10 are rotatably arranged. One end of the drive shaft 9 is provided with the drive gear 11, and one end of the driven shaft 10 is provided with the driven gear 12. The drive gear 11 engages with the driven gear 12. The rotor housing 8*b* has defined therein a main pump chamber 31 and an auxiliary pump chamber 32. The main pump chamber 31 has accommodated therein first and second main screw rotors 33, 34. The auxiliary pump chamber 32 has accommodated therein first and second auxiliary screw rotors 35, 36. The first main screw rotor 33 and the first auxiliary screw rotor 35 are integrally rotated with the drive shaft 9. The second main screw rotor 34 and the second auxiliary screw rotor 36 are integrally rotated with the driven shaft 10.

The main pump chamber 31, the first and second main screw rotors 33, 34 form a main pump 37. The auxiliary pump chamber 32, the first and second auxiliary screw rotors 35, 36 form an auxiliary pump 38. A first screw pitch p2 between the first and second auxiliary screw rotors 35, 36 is set to be smaller than a second screw pitch p1 between the first and second main screw rotors 33, 34. That is, since volume of the gas trapped in the auxiliary pump chamber 32 is smaller than that of the gas trapped in the main pump chamber 31, displacement of the auxiliary pump 38 is smaller than that of the main pump 37.

A part of the main pump chamber 31 is defined as a semi-exhaust chamber 311 communicating with a main exhaust port (not shown). The rotation of the first and second main screw rotors 33, 34 pumps the gas from a suction port side (not shown) to the main exhaust port side. The rotation of the first and second auxiliary screw rotors 35, 36 pumps a part of the gas in the semi-exhaust chamber 311 into the auxiliary pump chamber 32 through a passage 39 between the main pump chamber 31 and the auxiliary pump chamber 32 and then discharges the pumped gas outside the auxiliary pump chamber 32.

As is the case with the operation of the first embodiment, operation of the second embodiment is explained with reference to the flow chart in FIG. 3.

In the second embodiment of the present invention, reverse rotation and normal rotation are repeated by the driving motor if the driving motor is not started after normal rotation is attempted by the driving motor of the screw pump in low temperature environment. If the moisture freezes inside the roots pump, the frozen moisture is peeled off from the rotor or the casing of the screw pump by torque of reverse rotation and normal rotation. Thereby, the screw pump is enabled to start.

In the above first and second embodiments, alternative sensors may be used instead of the starter sensor 5 which senses whether or not the driving motor 2 has been started. These alternative sensors include a torque sensor which senses torque of the driving motor 2, an electric current sensor which senses a value of an electric current flowing into the driving motor 2, a sensor which senses number of rotation of the driving motor 2, or a pressure sensor which senses a discharge pressure of the roots pump 1 (or the screw pump 30).

In the above first and second embodiments, as the temperature sensor 6, a sensor which measures a temperature of the driving motor 2 instead of the outdoor air temperature T or a sensor which measures the temperature of the fuel cell stack may be used. However, since the temperature sensor 6 is intended to monitor the temperature at which the freeze of the moisture begins, it is efficiently estimated whether or not the driving motor 2 has been started if the outdoor air temperature T is measured. In addition, the preset temperature contrasted with the outdoor air temperature T in the step S3 of FIG. 3 is 4 degrees C., for the freeze of the moisture normally begins if temperature falls to about 4 degrees C. It is noted that the values other than 4 degrees C. may be adapted for the preset temperature.

In the above first embodiment, the roots pump 1 is transversely arranged such that the drive shaft 9 faces a horizontal direction, thereby locating a suction port which allows a working fluid to be introduced from the outside of the roots pump 1 to the rotor chamber 13 on the upside of the drive shaft 9 and a discharge port which allows the working fluid to be discharged from the rotor chamber 13 to the outside of the roots pump 1 on the downside of the drive shaft 9. It is noted that the roots pump 1 may be arranged such that the drive shaft 9 faces a vertical direction. In addition, the roots pump 1 may be longitudinally arranged such that the drive shaft 9 faces a vertical direction. Further, the roots pump 1 may be arranged at any angle.

The present invention is adapted for the roots pump or the screw pump, which is used as a hydrogen pump or an air pump supplying a fuel gas to a fuel cell in a fuel cell powered vehicle equipped with a battery. In addition, the present invention is also adapted for a roots blower which is used as an air conditioning apparatus in a fuel cell powered vehicle equipped with a battery.

Further, the present invention is also adapted for one of a roots pump, a screw pump and a roots blower used in a fixed power plant whose power source is supplied from a commercial power source instead of a battery. In this case, there is no need for measuring the charging capacity Ps of the battery 4 in the steps S6, S9 of FIG. 3.

Therefore, the present examples and embodiments are to be considered as illustrative and not restrictive and the invention is not to be limited to the details given herein but may be modified.

What is claimed is:

1. A starting system for a pump comprising:

a motor for driving the pump;

an electric source connected to the driving motor for supplying the driving motor with electric power;

a selector switch located between the driving motor and the electric source for reversing polarity of the electric power supplied from the electric source to the driving motor while selectively connecting the driving motor to the electric source and disconnecting the driving motor from the electric source;

a starter sensor provided with the driving motor for sensing whether or not the driving motor has been started;

a temperature sensor provided for sensing a temperature; and a control unit connected to the electric source, the selector switch, the starter sensor and the temperature sensor, wherein the control unit operates the selector switch so as to repeatedly give the driving motor indications of reverse rotation and normal rotation in a case where the starter sensor does not sense that the driving motor has been started even if the control unit operates the selector switch so as to give the driving motor the indication of normal rotation in a state where the temperature sensed by the temperature sensor is a preset temperature or below.

2. The starting system according to claim 1, wherein the temperature sensor measures an outdoor air temperature, the control unit operating the selector switch so as to repeatedly give the driving motor the indications of reverse rotation and normal rotation only in a case where the outdoor air temperature measured by the temperature sensor is the preset temperature or below.

3. The starting system according to claim 1, wherein the electric source is a battery, the control unit operating the selector switch so as to repeatedly give the driving motor the indications of reverse rotation and normal rotation only in a case where charging capacity of the battery is a preset value or above.

4. The starting system according to claim 1, wherein the starter sensor is a torque sensor for sensing torque of the driving motor.

5. The starting system according to claim 1, wherein the starter sensor is an electric current sensor for sensing a value of an electric current flowing into the driving motor.

6. The starting system according to claim 1, wherein the starter sensor is a sensor for sensing number of rotation of the driving motor.

7. The starting system according to claim 1, wherein the starter sensor is a pressure sensor for sensing a discharge pressure of the pump.

8. The starting system according to claim 1, wherein the pump pumps a fuel gas into a fuel cell system.

9. The starting system according to claim 1, wherein the pump is a roots pump.

10. The starting system according to claim 1, wherein the pump is a screw pump.

11. A method of starting a pump including a motor for driving the pump, comprising the steps of:

sensing a temperature;

giving the driving motor an indication of normal rotation; and starting the driving motor by giving the driving motor indications of reverse rotation and normal rotation repeatedly in a case where the driving motor is not started even if the indication of normal rotation is given to the driving motor in a state where the sensed temperature is a preset temperature or below.

12. The method according to claim 11, wherein the temperature is an outdoor air temperature, further comprising the step of:

giving the driving motor the indications of reverse rotation and normal rotation repeatedly only in a case where the outdoor air temperature is the preset temperature or below.

13. The method according to claim 11, further comprising the steps of:

providing a battery with the driving motor for supplying the driving motor with electric power;

measuring charging capacity of the battery; and giving the driving motor the indications of reverse rotation and normal rotation repeatedly only in a case where the charging capacity is a preset value or above.

14. The method according to claim 11, wherein the pump pumps a fuel gas into a fuel cell system.

15. The method according to claim 11, wherein the pump is a roots pump.

16. The method according to claim 11, wherein the pump is a screw pump.

17. A starting system for a pump motor, comprising:

a starter sensor located near the pump motor for ultimately determining an operational status of the pump motor, the operational status being active and inactive;

a temperature sensor for detecting a temperature; and a control unit connected to said starter sensor and said temperature sensor for generating a signal to the pump motor, in response to the inactive operational status from said starter sensor after a predetermined normal activation attempt of starting the pump motor, said control unit generating a reverse/forward rotation signal sequence indicative of alternately rotating the pump motor in a predetermined reverse direction and a predetermined forward direction if the detected temperature is equal to or below a predetermined temperature.

18. The starting system for a pump motor according to claim 17 wherein said control unit stops generating the reverse/forward rotation signal sequence when said starter sensor detects the active operational status.

19. The starting system for a pump motor according to claim 17 further comprising a power source connected to the pump motor, wherein said control unit generates the reverse/forward rotation signal sequence only if there is sufficient charge remaining in the power source to start the pump motor.

20. The starting system for a pump motor according to claim 17 wherein said temperature sensor detects an outside air temperature.

21. The starting system for a pump motor according to claim 17 wherein said temperature sensor detects an internal pump temperature.

22. The starting system for a pump motor according to claim 17 wherein said starter sensor detects torque outputted by the pump motor.

23. The starting system for a pump motor according to claim 17 wherein said starter sensor detects electric current flowing through the pump motor.

24. The starting system for a pump motor according to claim 17 wherein said starter sensor detects rotation caused by the pump motor.

25. The starting system for a pump motor according to claim 17 wherein said starter sensor detects pressure discharged by the pump motor.

26. A method of starting a pump motor, comprising the steps of:

rotating the pump motor in a predetermined forward direction;

determining an operational status of the pump motor, the operational status being active and inactive;

in response to the inactive operational status, detecting a temperature; and generating a reverse/forward rotation signal sequence indicative of alternately rotating the pump motor in a predetermined reverse direction and the predetermined forward direction if the detected temperature is equal to or below a predetermined temperature.

27. The method of starting a pump motor according to claim 26 wherein the reverse/forward rotation signal sequence is not generated when the active operational status is determined.

28. The method of starting a pump motor according to claim 26 further comprising additional steps of:

providing a power source for the pump motor; and generating the reverse/forward rotation signal sequence only if there is sufficient charge remaining in the power source to start the pump motor.

29. The method of starting a pump motor according to claim 26 wherein the temperature is an outside air temperature.

30. The method of starting a pump motor according to claim 26 wherein the temperature is an internal pump temperature.

31. The method of starting a pump motor according to claim 26 wherein the operational status is determined based upon torque outputted by the pump motor.

32. The method of starting a pump motor according to claim 26 wherein the operational status is determined based upon electric current flowing through the pump motor.

33. The method of starting a pump motor according to claim 26 wherein the operational status is determined based upon rotation caused by the pump motor.

34. The method of starting a pump motor according to claim 26 wherein the operational status is determined based upon pressure discharged by the pump motor.

* * * * *